US010157717B2

(12) United States Patent
Wu et al.

(10) Patent No.: US 10,157,717 B2
(45) Date of Patent: Dec. 18, 2018

(54) SWITCH DEVICE MOUNTING STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wu Yi Tsai, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/411,000

(22) Filed: Jan. 20, 2017

(65) Prior Publication Data

US 2017/0133172 A1 May 11, 2017

Related U.S. Application Data

(63) Continuation-in-part of application No. 14/725,231, filed on May 29, 2015, now Pat. No. 9,607,783.

(30) Foreign Application Priority Data

Jul. 8, 2014 (TW) ..... 103123502 A
Jan. 11, 2017 (TW) ..... 106100802 A

(51) Int. Cl.

| | |
|---|---|
| ***H01H 9/02*** | (2006.01) |
| ***H01H 9/20*** | (2006.01) |
| ***H01H 3/46*** | (2006.01) |
| ***H01H 9/08*** | (2006.01) |
| ***H01H 13/04*** | (2006.01) |
| *H01H 9/22* | (2006.01) |
| *H01H 13/50* | (2006.01) |

(52) U.S. Cl.

CPC ..... *H01H 9/20* (2013.01); *H01H 3/46* (2013.01); *H01H 9/02* (2013.01); *H01H 9/08* (2013.01); *H01H 13/04* (2013.01); *H01H 9/223* (2013.01); *H01H 13/503* (2013.01); *H01H 2235/01* (2013.01)

(58) Field of Classification Search

CPC ..... H01H 50/023; H01H 13/06; H01H 9/00; H01H 19/635

USPC ..... 200/295, 561, 329, 338, 302.2; 439/712

See application file for complete search history.

(56) References Cited

U.S. PATENT DOCUMENTS 3,898,402 A * 8/1975 Ford ..... H01H 13/36 200/409
5,420,555 A * 5/1995 Toguchi ..... H01H 13/063 200/243
8,499,852 B2 * 8/2013 Chen ..... B25F 5/00 173/169

* cited by examiner

*Primary Examiner* — Vanessa Girardi
(74) *Attorney, Agent, or Firm* — Rosenberg, Klein & Lee

(57) ABSTRACT

A switch device structure serves to help in stably moving an operation rod. The switch device includes a contact fixing support assembled with an insulation case. The fixing support is formed with multiple openings. A connection board and multiple support members are correspondingly assembled in the openings. The support member has a base section and a neck section, which together define a passage. The operation rod is assembled with an elastic unit and can pass through the passage and the connection board to extend into the fixing support so as to move a wire connection assembly in the case. The switch device structure improves the shortcoming of the conventional switch device that the operation rod is apt to shake and deflect.

19 Claims, 3 Drawing Sheets

SWITCH DEVICE MOUNTING STRUCTURE

CROSS-REFERENCE TO RELATED APPLICATION

This application is a continuation-in-part application of U.S. patent application Ser. No. 14/725,231, filed May 29, 2015, entitled "SWITCH DEVICE MOUNTING STRUCTURE," now U.S. Pat. No. 9,607,783.

BACKGROUND OF THE INVENTION

1. Field of the Invention

The present invention relates generally to an improved switch device structure, and more particularly to a switch device having a connection board and multiple support members assembled with a fixing support (or contact support), whereby the operation rod can be stably operated.

2. Description of the Related Art

A conventional switch indication device or switch device is applied to an electrical, electronic and automatic control system for an operator to operate or power on/off the system on the console. For example, a restriction switch or travel switch is applied to mechanical equipment for controlling the motional travel thereof. In general, the switch device is installed in a predetermined position. When a motional part of the mechanical equipment hits the contact of the restriction switch, the restriction switch will switch the circuits to control the travel of the mechanical equipment and provide terminal restriction protection.

The conventional (restriction) switch device generally includes multiple contact seats (or insulation cases), which are side by side assembled with each other. A wire connection assembly is disposed in each contact seat. The contact seats are securely locked with a contact fixing support by means of screws and spring lock washers to form an integrated form. Basically, the contact fixing support is formed with openings. The operation rods can pass through the openings and extend into the contact seats to touch and move the wire connection assemblies to achieve an effect as a restriction switch.

With respect to the structure, operation and application of such restriction switch device, the opening of the contact fixing support only provides a path for the operation rod to get into the insulation case to touch and move the wire connection assembly. Therefore, the opening is not designed with any structure to sealedly assemble with the operation rod. As a result, when operating the operation rod to reciprocally touch and move the wire connection assembly, the operation rod is apt to deflect and shake. This will affect or deteriorate the moving effect of the operation rod to the wire connection assembly.

As well known by those who are skilled in this field, in the conventional switch device, the opening of the contact fixing support is not designed with any structure to sealedly assemble with the operation rod. Therefore, during the long-term use of the conventional switch device, dust, liquid, humidity or the like tends to infiltrate into the switch device through the opening and accumulate on the contact fixing support, the case and the wire connection assembly to affect the operation of the switch device or cause short-circuit. This is not what we expect.

To speak representatively, the above description reveals some shortcomings of the contact seat (or the insulation case), the contact fixing support and the relevant connection components of the conventional switch device in use and structural design. Incase the contact fixing support and the relevant components are redesigned to be different from the conventional switch device, the use form of the switch device can be changed to widen the application range thereof. For example, in comparison with the conventional switch device, a specific cooperative structure is disposed between the opening of the fixing support and the operation rod to enhance the sealing extent therebetween. This improves the shortcoming of the conventional switch device that when the operation rod is operated to reciprocally move the wire connection assembly, the operation rod is apt to deflect and shake to affect or deteriorate the moving effect of the operation rod to the wire connection assembly. Moreover, during the long-term use of the conventional switch device, dust, liquid, humidity or the like tends to infiltrate into the switch device through the opening and accumulate on the contact fixing support, the case and the wire connection assembly to affect the operation of the switch device or cause short-circuit. The specific cooperative structure between the opening of the fixing support and the operation rod as minimizes this shortcoming as possible.

SUMMARY OF THE INVENTION

It is therefore a primary object of the present invention to provide a switch device structure serves to help in stably moving an operation rod. The switch device includes a contact fixing support assembled with an insulation case. The fixing support is formed with multiple openings. A connection board and multiple support members are correspondingly assembled in the openings. The support member has a base section and a neck section, which together define a passage. The operation rod is assembled with an elastic unit and can pass through the passage and the connection board to extend into the fixing support so as to move a wire connection assembly in the case. The switch device structure improves the shortcoming of the conventional switch device that the operation rod is apt to shake and deflect.

In the above switch device structure, the connection board has a board-shaped base section and neck sections protruding from the base section. Each neck section has a closed end and an internal room. The neck section of the connection board is assembled or sealedly assembled in the opening of the fixing support. The neck section of the support member is assembled or sealedly assembled in the neck section or internal room of the connection board. The passage of the support member at least includes a first passage and a second passage with a width (or inner diameter) larger than the first passage, whereby the width (or inner diameter) of the first passage is approximately equal to the width (or outer diameter) of the operation rod, permitting the operation rod to pass through the first passage to freely reciprocally move. The elastic unit is securely assembled in the second passage to together forma sealedly assembled structure.

The present invention can be best understood through the following description and accompanying drawings, wherein:

DETAILED DESCRIPTION OF THE PREFERRED EMBODIMENTS

Figure 1:
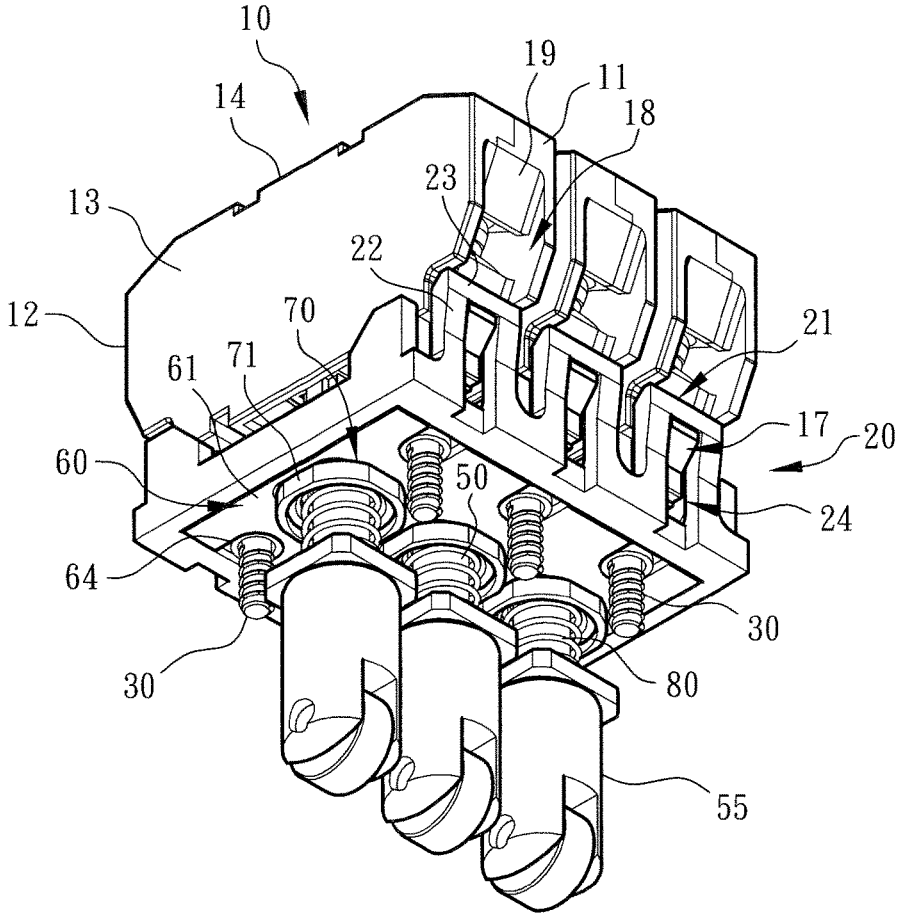
FIG. 1 is a perspective assembled view of the switch device of the present invention, showing the cases, the fixing support, the connection board, the support members, the elastic units and the operation rods of the switch device.
Figure 2:
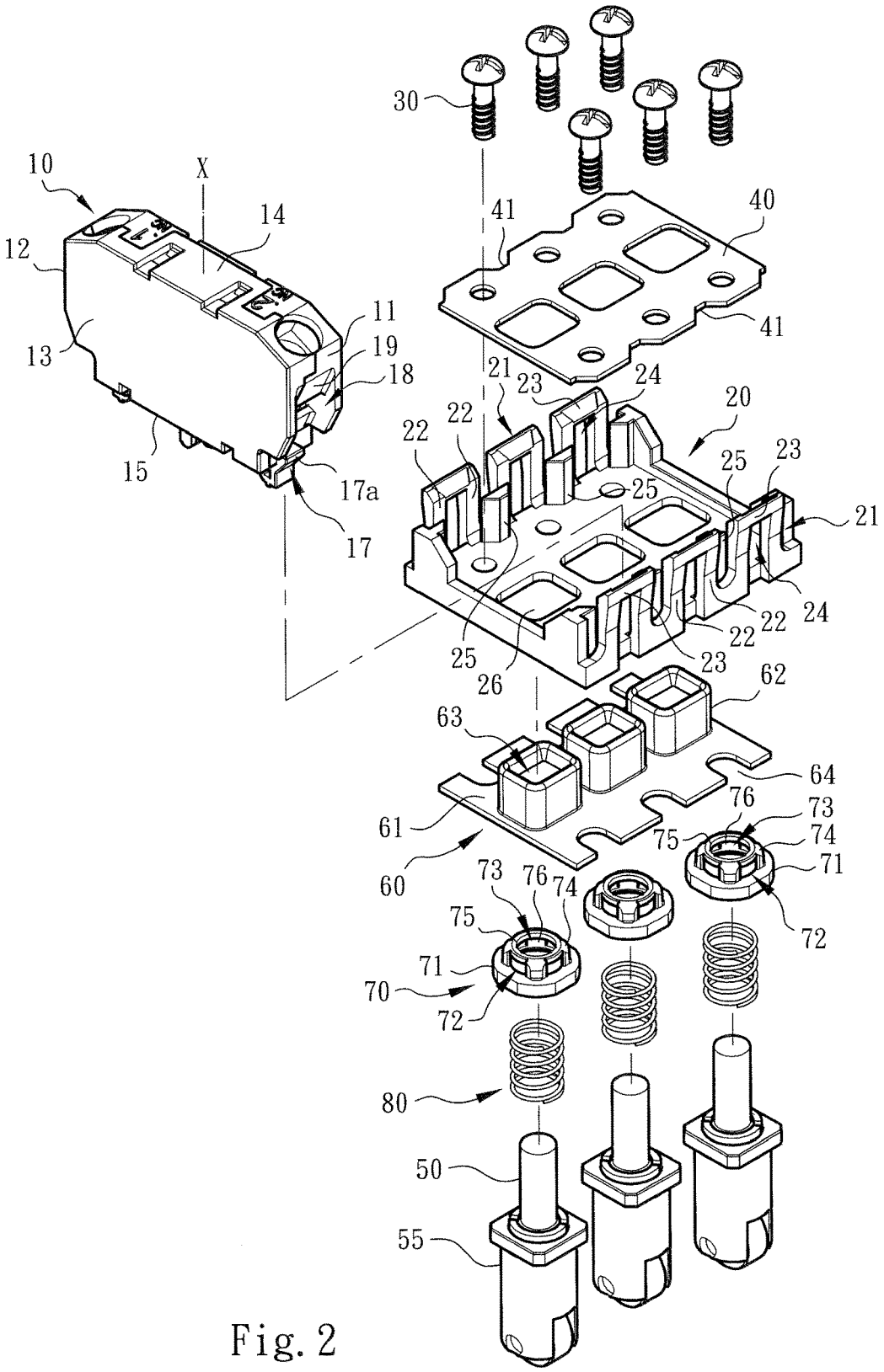
FIG. 2 is a perspective exploded view according to FIG. 1, showing the structures of the cases, the fixing plate, the fixing support, the connection board, the support members, the elastic units and the operation rods of the switch device.
Figure 3:
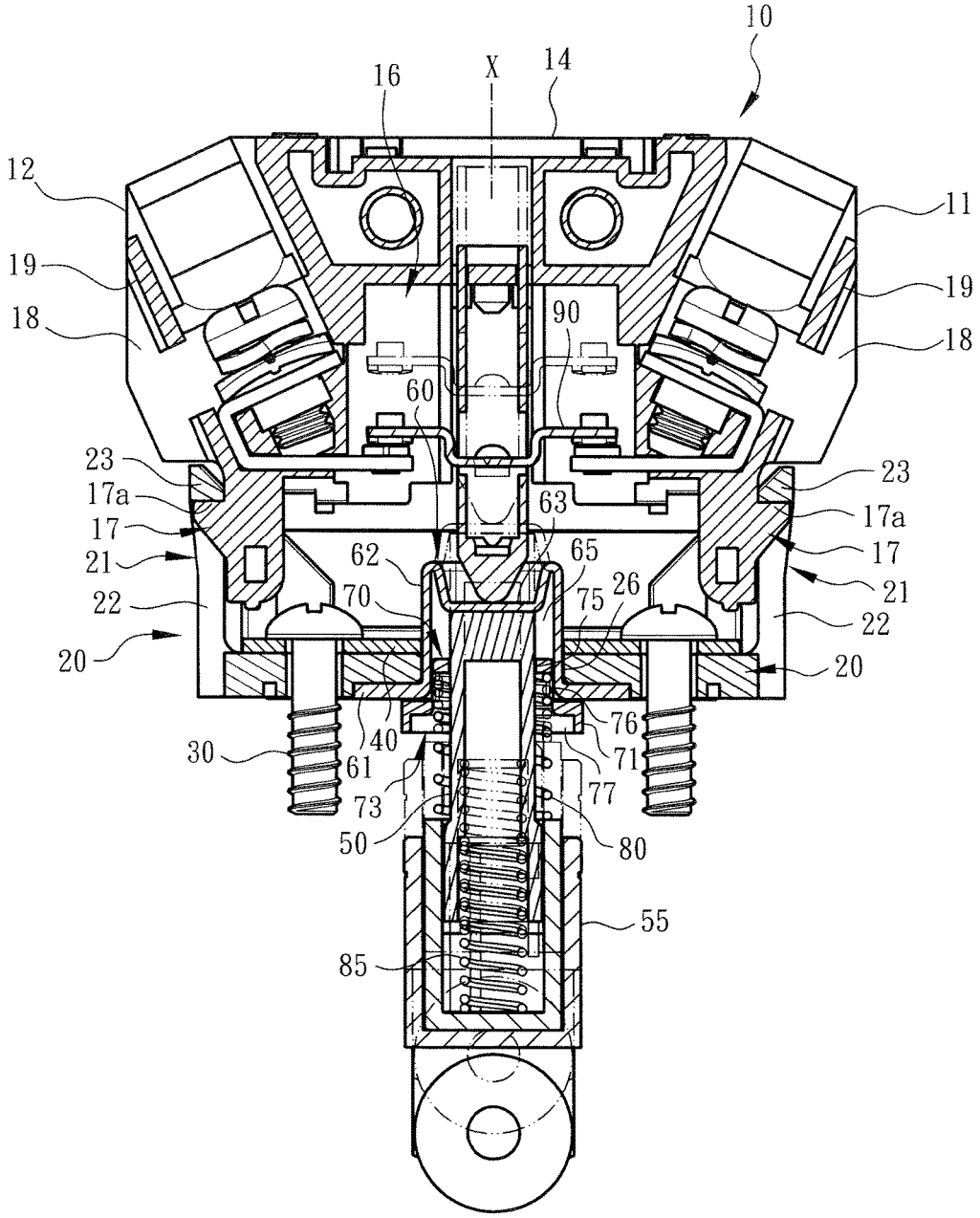
FIG. 3 is a plane sectional view of the switch device of the present invention, showing that the cases, the wire connection assemblies, the fixing plate, the fixing support, the connection board, the support members, the elastic units and the operation rods of the switch device are assembled with each other.

Please refer to FIGS. 1, 2 and 3. According to a preferred embodiment, the switch device structure of the present invention is a restriction or travel switch device for illustration purposes. The switch device has three contact seats (or insulation cases 10) side by side assembled with each other. The cases 10 are latched and connected with a (contact) fixing support 20. The fixing support 20 is selectively locked with a fixing plate 40 and a connection board 60 by means of screws 30. The fixing plate 40 and the connection board 60 permit the operation rods 50 to extend into the fixing support 20 to touch and move the wire connection assemblies 90 in the cases 10 to achieve an effect as a conventional restriction switch.

In this embodiment, the case 10 is defined with an axis $\chi$. The case 10 has a first end wall 11, a second end wall 12, two sidewalls 13, an upper section 14 and a bottom section 15 to together define a cavity 16 for arranging a wire connection assembly 90 therein. The case 10 has an assembling section 17 protruding from the first end wall 11 and/or the second end wall 12 and an oblique socket 18 directed to and related to the assembling section 17. A block body or shoulder section 17*a* protrudes from a portion of the assembling section 17 near the bottom section 15 in a direction to two ends of the case 10 (away from the axis $\chi$).

In addition, two ends of the fixing support 20 are respectively formed with latch sections 21 corresponding to the assembling section 17 and the oblique socket 18. As shown in the drawings, multiple continuously arranged latch sections 21 are formed at two ends of the fixing support 20 in accordance with the number of the cases 10. The assembling sections 17 of the contact seats 10 are detachably latched with the latch sections 21 to form an integrated structure.

To speak more specifically, each latch section 21 of the fixing support 20 has two protruding cantilevers 22 and a connection section 23 connected between the two cantilevers 22 to together define a space 24. Accordingly, the latch section 21 has a U-shaped (cross-sectional) configuration with elasticity. Also as shown in the drawings, the oblique socket 18 is a structure inclined from the first and second end walls 11, 12 to the axis $\chi$. The oblique socket 18 includes a slope 19 inclined to the axis $\chi$ for supporting and guiding a tool to insert into the case 10. (This will be further described hereinafter.)

FIG. 2 also shows that the fixing support 20 is formed with at least one stake 25 positioned between the adjacent latch sections 21 and having trapezoidal cross section. The edge of the fixing plate 40 is formed with notches 41 in alignment with the stakes 25 for assembling or inlaying the stakes 25. Accordingly, the fixing plate 40 can be securely assembled with the fixing support 20.

FIG. 3 shows that an operator can directly operate the latch sections 21 to latch with the assembling sections 17 of the case 10 to assemble the fixing support 20 with the case 10. As shown in the drawings, the assembling section 17 (or the shoulder section 17*a*) is relatively positioned in the space 24 of the fixing support 20 with the connection section 23 pressed onto the assembling section 17. In this case, the connection section 23 is positioned in the inclined path of the oblique socket 18.

Therefore, an operator can use a tool (such as a screwdriver) to pass through the oblique socket 18 and directly push away the connection section 23 of the latch section 21 from the assembling section 17 with the slope 19 serving as a (force application) fulcrum. Accordingly, the case 10 and the fixing support 20 can be quickly installed/uninstalled. To speak more specifically, the stakes 25 are disposed between the latch sections 21 of the fixing support 20 to help the operator in operating the tool to pass through the oblique socket 18 and push away the connection section 23 of the latch section 21 from the assembling section 17 with the slope 19 serving as a force application face or force application point. At this time, the stakes 25 at the other end of the fixing support 20 serve as abutment points or swinging fulcrums to help in detaching the case 10 from the fixing support 20.

Please further refer to FIGS. 1, 2 and 3. In this embodiment, the fixing support 20 is assembled with the connection board 60 and the operation rods 50. The fixing support 20 is formed with at least one or multiple openings 26. The connection board 60 has a board-shaped base section 61 and neck sections 62 protruding from the base section 61. Each neck section 62 has a closed end 63 and an internal room 65. The connection board 60 is selectively made of rubber or the like material, whereby the neck sections 62 of the connection board 60 can be elastically assembled or sealedly assembled in the openings 26 of the fixing support 20. Two sides or a peripheral section of the connection board 60 is formed with multiple notches 64 for the screws 30 to pass through so as to securely assemble the components.

In a preferred embodiment, a support member 70 is disposed between the fixing support 20 (or the connection board 60) and the operation rod 50. The support member 70 is correspondingly assembled in the opening 26. As shown in the drawings, the support member 70 is assembled with the neck section 62 or internal room 65 of the connection board 60. The support member 70 has a base section 71 and a neck section 72 protruding from the base section 71 to together define a passage 73. The elastic unit 80 is fitted around the operation rod 50, which can pass through the passage 73 and the connection board 60 and extend into the fixing support 20 so as to touch and move the wire connection assembly 90 in the case 10. Basically, the operation rod 50 is assembled on a plunger main body 55. A spring 85 is disposed in the plunger main body 55 to help in moving the operation rod 50. This part pertains to prior art and thus will not be further described hereinafter.

As shown in the drawings, the neck sections 72 of the support member 70 can be assembled or sealedly assembled in the neck section 62 or internal room 65 of the connection board 60 with the base section 71 of the support member 70 in contact with or in connection with the base section 61 of the connection board 60. In a preferred embodiment, the neck section 72 of the support member 70 is formed with multiple wing sections 74 to help in securely assembling the support member 70 in the opening 26 of the fixing support 20 (or the internal room 65 of the neck section 72 of the connection board 60).

As shown in FIGS. 2 and 3, the passage 73 of the support member 70 at least includes a first passage 75 and a second passage 76 with a cross-sectional width (or inner diameter) larger than the first passage 75. Accordingly, the cross-sectional width (or inner diameter) of the first passage 75 is approximately equal to the cross-sectional width (or outer diameter) of the operation rod 50, whereby the operation rod 50 can pass through the first passage 75 to freely reciprocally move. One end of the elastic unit 80 is securely assembled in the second passage 76 to together form a sealedly assembled structure. This improves the shortcoming of the conventional operation rod that in operation, the operation rod is apt to shake and deflect.

As shown in the drawings, the passage 73 of the support member 70 further has a subsidiary passage 77 formed on the base section 71 of the support member 70. The width (or inner diameter) of the subsidiary passage 77 is larger than the width (or inner diameter) of the second passage 76.

It should be noted that the structures of the base section 71, the neck section 72 and the passage 73 (or the first passage 75) of the support member 70 serve to restrict and keep the motion of the operation rod 50 stable and prevent the operation rod 50 from shaking or deflecting during operation. Moreover, one end of the elastic unit 80 is securely assembled in the neck section 72 and the passage 73 (or the second passage 76) of the support member 70, whereby the travel or specification of the elastic unit 80 can be increased. Such arrangement is applicable to an operation rod necessitating longer operation distance or travel.

To speak representatively, in the condition that the switch device structure is easy to operate, in comparison with the conventional switch device, the switch device structure of the present invention has the following advantages:

1. The fixing support 20, the support member 70 and the relevant components and structures have been redesigned, and the assembling or sealedly assembling structures of the fixing support 20, the connection board 60, the support member 70 and the operation rod 50 are specifically considered to be different from the conventional switch device and change the use and operation form thereof. For example, the neck section 62 of the connection board 60 is sealedly assembled in the opening 26 of the fixing support. The support member 70 has a base section 71, a neck section 72 and a passage 73 (or the first and second passages 75, 76). The neck sections 72 of the support member 70 is sealedly and securely assembled in the opening 26 of the fixing support and the neck section 62 of the connection board 60. These are obviously different from the structural form of the conventional switch device.
2. Especially, the structures of the opening 26 of the fixing support 20, the base section 61, the neck section 62, the closed end 63 and the internal room 65 of the connection board 60, the base section 71, the neck section 72 and the passage 73 (or the first and second passages 75, 76) of the support member 70, the operation rod 50 and the elastic unit 80 enhance the sealing extent of the assembly and improve the shortcomings of the conventional switch device that when the operation rod is operated to reciprocally move the wire connection assembly, the operation rod is apt to deflect and shake to affect or deteriorate the moving effect of the operation rod to the wire connection assembly. Moreover, during the long-term use of the conventional switch device, dust, liquid, humidity or the like tends to infiltrate into the switch device through the opening and accumulate on the contact fixing support, the case and the wire connection assembly to affect the operation of the switch device or cause short-circuit. The present invention as minimizes this shortcoming as possible.

In conclusion, the switch device structure of the present invention is effective and different from the conventional switch device in space form and is advantageous over the conventional switch device. The switch device structure of the present invention is considerably greatly advanced and inventive.

The above embodiments are only used to illustrate the present invention, not intended to limit the scope thereof. Many modifications of the above embodiments can be made without departing from the spirit of the present invention.

What is claimed is:

1. A switch device mounting structure for stabilizing movement of an operation rod in engaging a wire connection assembly of a switch, the switch device mounting structure comprising:

a fixing support having at least one opening, the fixing support configured to be assembled with a case for a wire connection assembly; and a support member correspondingly assembled securely in the opening of the fixing support, the support member having a base section and a neck section which together define a passage, wherein an operation rod assembled with an elastic unit extends through the passage of the support member into the opening of the fixing support to thereby move the wire connection assembly, the support member being positioned between the fixing support and the operation rod, the neck section of the support member being formed with multiple wing sections securing the support member to the fixing support.

2. The switch device mounting structure as claimed in claim 1, wherein two ends of the fixing support are formed with latch sections for assembling with the case, the fixing support being locked with a fixing plate by means of screws, the case being defined with an axis, the case having a first end wall, a second end wall, two sidewalls, an upper section and a bottom section to together define a cavity for arranging the wire connection assembly therein, whereby the operation rod can extend into the case to touch and move the wire connection assembly, the case having an assembling section protruding from the first and second end walls and an oblique socket directed to and related to the assembling section, the assembling section being assembled with at least one of the latch sections of the fixing support, a shoulder section protruding from a portion of the assembling section near the bottom section in a direction away from the axis, the oblique socket being a structure inclined from the first and second end walls to the axis, the oblique socket including a slope inclined to the axis, the latch section of the fixing support having two protruding cantilevers and a connection section connected between the two cantilevers to together define a space, whereby the latch section has a U-shaped configuration with elasticity, the fixing support being formed with at least one stake positioned between the adjacent latch sections and having a trapezoidal cross section, an edge of the fixing plate being formed with notches in alignment with the stakes for assembling with the stakes, the operation rod being assembled on a plunger main body, a spring being disposed in the plunger main body.

3. The switch device mounting structure as claimed in claim 1, wherein the passage of the support member at least includes a first passage and a second passage with a width larger than the first passage, whereby the width of the first passage is equal to the width of the operation rod, thereby permitting the operation rod to pass through the first passage to freely reciprocally move, one end of the elastic unit being securely assembled in the second passage.

4. The switch device mounting structure as claimed in claim 3, wherein the passage of the support member further has a subsidiary passage formed on the base section of the support member, the subsidiary passage having a width larger than the width of the second passage.

5. The switch device mounting structure as claimed in claim 3, wherein two ends of the fixing support are formed with latch sections for assembling with the case, the fixing support being locked with a fixing plate by means of screws, the case being defined with an axis, the case having a first end wall, a second end wall, two sidewalls, an upper section and a bottom section to together define a cavity for arranging he wire connection assembly therein, whereby the operation rod can extend into the case to touch and move the wire connection assembly, the case having an assembling section protruding from the first and second end walls and an oblique socket directed to and related to the assembling section, the assembling section being assembled with at least one of the latch sections of the fixing support, a shoulder section protruding from a portion of the assembling section near the bottom section in a direction away from the axis, the oblique socket being a structure inclined from the first and second end walls to the axis, the oblique socket including a slope inclined to the axis, the latch section of the fixing support having two protruding cantilevers and a connection section connected between the two cantilevers to together define a space, whereby the latch section has a U-shaped configuration with elasticity, the fixing support being formed with at least one stake positioned between the adjacent latch sections and having a trapezoidal cross section, an edge of the fixing plate being formed with notches in alignment with the stakes for assembling with the stakes, the operation rod being assembled on a plunger main body, a spring being disposed in the plunger main body.

6. The switch device mounting structure as claimed in claim 1, wherein a rubber-made connection board is disposed between the fixing support and the operation rod, the connection board having a board-shaped base section and neck sections protruding from the base section, each neck section having a closed end and an internal room, whereby the neck section of the connection board can be assembled in the opening of the fixing support, the neck section of the support member protruding from the base section of the support member, the neck section of the support member being assembled in the neck section of the connection board, whereby the operation rod extends through the passage of the support member and the base section of the connection board into the opening of the fixing support.

7. The switch device mounting structure as claimed in claim 6, wherein two ends of the fixing support are formed with latch sections for assembling with the case, the fixing support being locked with a fixing plate by means of screws, the case being defined with an axis, the case having a first end wall, a second end wall, two sidewalls, an upper section and a bottom section to together define a cavity for arranging the wire connection assembly therein, whereby the operation rod can extend into the case to touch and move the wire connection assembly, the case having an assembling section protruding from the first and second end walls and an oblique socket directed to and related to the assembling section, the assembling section being assembled with at least one of the latch sections of the fixing support, a shoulder section protruding from a portion of the assembling section near the bottom section in a direction away from the axis, the oblique socket being a structure inclined from the first and second end walls to the axis, the oblique socket including a slope inclined to the axis, the latch section of the fixing support having two protruding cantilevers and a connection section connected between the two cantilevers to together define a space, whereby the latch section has a U-shaped configuration with elasticity, the fixing support being formed with at least one stake positioned between the adjacent latch sections and having a trapezoidal cross section, an edge of the fixing plate being formed with notches in alignment with the stakes for assembling with the stakes, the operation rod being assembled on a plunger main body, a spring being disposed in the plunger main body, two sides of the connection board being formed with multiple notches for the screws to pass through and fix.

8. The switch device mounting structure as claimed in claim 6, wherein the passage of the support member at least includes a first passage and a second passage with a width larger than the first passage, whereby the width of the first passage is equal to the width of the operation rod, thereby permitting the operation rod to pass through the first passage to freely reciprocally move, one end of the elastic unit being securely assembled in the second passage.

9. The switch device mounting structure as claimed in claim 8, wherein the passage of the support member further has a subsidiary passage formed on the base section of the support member, the subsidiary passage having a width larger than the width of the second passage.

10. The switch device mounting structure as claimed in claim 8, wherein two ends of the fixing support are formed with latch sections for assembling with the case, the fixing support being locked with a fixing plate by means of screws, the case being defined with an axis, the case having a first end wall, a second end wall, two sidewalls, an upper section and a bottom section to together define a cavity for arranging the wire connection assembly therein, whereby the operation rod can extend into the case to touch and move the wire connection assembly, the case having an assembling section protruding from the first and second end walls and an oblique socket directed to and related to the assembling section, the assembling section being assembled with at least one of the latch sections of the fixing support, a shoulder section protruding from a portion of the assembling section near the bottom section in a direction away from the axis, the oblique socket being a structure inclined from the first and second endwalls to the axis, the oblique socket including a slope inclined to the axis, the latch section of the fixing support having two protruding cantilevers and a connection section connected between the two cantilevers to together define a space, whereby the latch section has a U-shaped configuration with elasticity, the fixing support being formed with at least one stake positioned between the adjacent latch sections and having a trapezoidal cross section, an edge of the fixing plate being formed with notches in alignment with the stakes for assembling with the stakes, the operation rod being assembled on a plunger main body, a spring being disposed in the plunger main body, two sides of the connection board being formed with multiple notches for the screws to pass through and fix.

11. The switch device mounting structure as claimed in claim 6, wherein the neck section of the support member is formed with multiple wing sections securing the support member to the fixing support, the base section of the support member being in contact with the base section of the connection board, the neck section of the support member being sealedly assembled in the internal room of the neck section of the connection board.

12. The switch device mounting structure as claimed in claim 11, wherein two ends of the fixing support are formed with latch sections for assembling with the case, the fixing support being locked with a fixing plate by means of screws, the case being defined with an axis, the case having a first end wall, a second end wall, two sidewalls, an upper section and a bottom section to together define a cavity for arranging the wire connection assembly therein, whereby the operation rod can extend into the case to touch and move the wire connection assembly, the case having an assembling section protruding from the first and second end walls and an oblique socket directed to and related to the assembling section, the assembling section being assembled with at least one of the latch sections of the fixing support, a shoulder section protruding from a portion of the assembling section near the bottom section in a direction away from the axis, the oblique socket being a structure inclined from the first and second end walls to the axis, the oblique socket including a slope inclined to the axis, the latch section of the fixing support having two protruding cantilevers and a connection section connected between the two cantilevers to together define a space, whereby the latch section has a U-shaped configuration with elasticity, the fixing support being formed with at least one stake positioned between the adjacent latch sectionsand having a trapezoidal cross section, an edge of the fixing plate being formed with notches in alignment with the stakes for assembling with the stakes, the operation rod being assembled on a plunger main body, a spring being disposed in the plunger main body, two sides of the connection board being formed with multiple notches for the screws to pass through and fix.

13. The switch device mounting structure as claimed in claim 11, wherein the passage of the support member at least includes a first passage and a second passage with a width larger than the first passage, whereby the width of the first passage is equal to the width of the operation rod, thereby permitting the operation rod to pass through the first passage to freely reciprocally move, one end of the elastic unit being securely assembled in the second passage.

14. The switch device mounting structure as claimed in claim 13, wherein the passage of the support member further has a subsidiary passage formed on the base section of the support member, the subsidiary passage having a width larger than the width of the second passage.

15. The switch device mounting structure as claimed in claim 13, wherein two ends of the fixing support are formed with latch sections for assembling with the case, the fixing support being locked with a fixing plate by means of screws, the case being defined with an axis, the case having a first end wall, a second end wall, two sidewalls, an upper section and a bottom section to together define a cavity for arranging the wire connection assembly therein, whereby the operation rod can extend into the case to touch and move the wire connection assembly, the case having an assembling section protruding from thefirst and second end walls and an oblique socket directed to and related to the assembling section, the assembling section being assembled with at least one of the latch sections of the fixing support, a shoulder section protruding from a portion of the assembling section near the bottom section in a direction away from the axis, the oblique socket being a structure inclined from the first and second end walls to the axis, the oblique socket including a slope inclined to the axis, the latch section of the fixing support having two protruding cantilevers and a connection section connected between the two cantilevers to together define a space, whereby the latch section has a U-shaped configuration with elasticity, the fixing support being formed with at least one stake positioned between the adjacent latch sections and having a trapezoidal cross section, an edge of the fixing plate being formed with notches in alignment with the stakes for assembling with the stakes, the operation rod being assembled on a plunger main body, a spring being disposed in the plunger main body, two sides of the connection board being formed with multiple notches for the screws to pass through and fix.

16. T A switch device mounting structure for stabilizing movement of an operation rod in engaging a wire connection assembly of a switch, the switch device mounting structure comprising:

a fixing support having at least one opening, the fixing support configured to be assembled with a case for a wire connection assembly; and a support member correspondingly assembled securely in the opening of the fixing support, the support member having a base section and a neck section which together define a passage, the passage of the support member at least includes a first passage and a second passage with a width larger than the first passage, wherein an operation rod assembled with an elastic unit extends through the passage of the support member into the opening of the fixing support to thereby move the wire connection assembly, whereby the width of the first passage is equal to the width of the operation rod, thereby permitting the operation rod to pass through the first passage to freely reciprocally move, one end of the elastic unit being securely assembled in the second passage.

17. The switch device mounting structure as claimed in claim 16, wherein the passage of the support member further has a subsidiary passage formed on the base section of the support member, the subsidiary passage having a width larger than the width of the second passage.

18. The switch device mounting structure as claimed in claim 16, wherein two ends of the fixing support are formed with latch sections for assembling with the case, the fixing support being locked with a fixing plate by means of screws, the case being defined with an axis, the case having a first end wall, a second end wall, two sidewalls, an upper section and a bottom section to together define a cavity for arranging the wire connection assembly therein, whereby the operation rod can extend into the case to touch and move the wire connection assembly, the case having an assembling section protruding from the first and second end walls and an oblique socket directed to and related to the assembling section, the assembling section being assembled with at least one of the latch sections of the fixing support, a shoulder section protruding from a portion of the assembling section near the bottom section in a direction away from the axis, the oblique socket being a structure inclined from the first and second end walls to the axis, the oblique socket including a slope inclined to the axis, the latch section of the fixing support having two protruding cantilevers and a connection-section connected between the two cantilevers to together define a space, whereby the latch section has a U-shaped configuration with elasticity, the fixing support being formed with at least one stake positioned between the adjacent latch sections and having a trapezoidal cross section, an edge of the fixing plate being formed with notches in alignment with the stakes for assembling with the stakes, the operation rod being assembled on a plunger main body, a spring being disposed in the plunger main body.

19. A switch device mounting structure for stabilizing movement of an operation rod in engaging a wire connection assembly of a switch, the switch device mounting structure comprising:

a case, the case being defined with an axis, the case having a first end wall, a second end wall, two sidewalls, an upper section and a bottom section to together define a cavity for arranging a wire connection assembly therein, the case having an assembling section protruding from the first and second end walls and an oblique socket directed to and related to the assembling section;

a fixing support having at least one opening, the fixing support configured to be assembled with the case for the wire connection assembly, two ends of the fixing support being formed with latch sections for assembling with the case, the fixing support being locked with a fixing plate by means of screws; and a support member correspondingly assembled securely in the opening of the fixing support, the support member having a base section and a neck section which together define a passage, wherein an operation rod assembled with an elastic unit extends through the passage of the support member into the opening of the fixing support to therebymove the wire connection assembly, the operation rod can extend into the case to touch and move the wire connection assembly, the assembling section being assembled with at least one of the latch sections of the fixing support, a shoulder section protruding from a portion of the assembling section near the bottom section in a direction away from the axis, the oblique socket being a structure inclined from the first and second end walls to the axis, the oblique socket including a slope inclined to the axis, the latch section of the fixing support having two protruding cantilevers and a connection section connected between the two cantilevers to together define a space, whereby the latch section has a U-shaped configuration with elasticity, the fixing support being formed with at least one stake positioned between the adjacent latch sections and having a trapezoidal cross section, an edge of the fixing plate being formed with notches in alignment with the stakes for assembling with the stakes, the operation rod being assembled on a plunger main body, a spring being disposed in the plunger main body.

* * * * *